US007270593B2

(12) United States Patent
Klein, II et al.

(10) Patent No.: US 7,270,593 B2
(45) Date of Patent: Sep. 18, 2007

(54) LIGHT BEAM TARGETING AND POSITIONING SYSTEM FOR A PAINT OR COATING REMOVAL BLASTING SYSTEM

(75) Inventors: Richard J. Klein, II, Waterloo, IA (US); Christopher A. Lampe, Parkersburg, IA (US)

(73) Assignee: University of Northern Iowa Research Foundation, Cedar Falls, IA (US)

( * ) Notice: Subject to any disclaimer, the term of this patent is extended or adjusted under 35 U.S.C. 154(b) by 0 days.

(21) Appl. No.: 11/334,270

(22) Filed: Jan. 18, 2006

(65) Prior Publication Data

US 2007/0167113 A1 Jul. 19, 2007

(51) Int. Cl.
*B24B 49/00* (2006.01)

(52) U.S. Cl. ..... 451/6; 451/38; 451/9

(58) Field of Classification Search ..... 451/6, 451/8–11, 38, 75, 90, 102
See application file for complete search history.

(56) References Cited

U.S. PATENT DOCUMENTS

| | | | |
|---|---|---|---|
| 3,117,480 | A | 1/1964 | Peddinghaus |
| 4,769,523 | A | 9/1988 | Tanimoto et al. |
| 4,836,671 | A | 6/1989 | Bautista |
| 4,982,897 | A | 1/1991 | Matusita et al. |
| 5,194,723 | A | 3/1993 | Cates et al. |
| 5,281,798 | A | 1/1994 | Hamm et al. |
| 5,473,136 | A | 12/1995 | Engelhardt et al. |
| 5,492,497 | A | 2/1996 | Brooke et al. |
| 5,598,972 | A | 2/1997 | Klein, II et al. |
| 5,605,496 | A | 2/1997 | Pickard |
| 5,757,498 | A | 5/1998 | Klein, II et al. |
| 5,782,253 | A | 7/1998 | Cates et al. |
| 5,857,625 | A | 1/1999 | Klein et al. |
| 5,864,114 | A | 1/1999 | Fukuda |
| 5,868,840 | A | 2/1999 | Klein, II et al. |
| 5,947,800 | A | 9/1999 | Fring |
| 5,951,296 | A | 9/1999 | Klein |

(Continued)

FOREIGN PATENT DOCUMENTS

| | | |
|---|---|---|
| WO | WO98/47657 | 10/1998 |

*Primary Examiner*—Dung Van Nguyen
(74) *Attorney, Agent, or Firm*—Andrus, Sceales, Starke & Sawall, LLP

(57) ABSTRACT

A blasting system for the removal of coatings or paint from an underlying surface uses an optical device to position the blasting nozzle an appropriate stand-off distance from the surface. The blasting media can use a variety of blasting media including abrasives, water, and various specialty blasting media. The preferred optical system is mounted to or integral with the blasting nozzle, and uses a diode laser, a beam splitter and a reflecting mirror to generate a reference beam and a gauge beam. Alternatively, two diode lasers can be used to generate the reference beam and gauge beam respectively. The reference beam propagates in a fixed forward direction, but the direction of the gauge beam is adjustable. The user adjusts the orientation of the gauge beam so that the image of the beam on the surface aligns with the image of the reference beam on the surface when the blasting nozzle is positioned at the appropriate stand-off distance from the surface. Alternatively, the center of the blasting pattern o the surface can be used as a rough estimate for the reference beam, thereby avoiding the need to generate and align two non-parallel beams.

18 Claims, 4 Drawing Sheets

U.S. PATENT DOCUMENTS

| | | | | |
|---|---|---|---|---|
| 5,970,993 | A | 10/1999 | Witherspoon et al. | |
| 5,986,234 | A | 11/1999 | Matthews et al. | |
| 6,106,377 | A | 8/2000 | Chu et al. | |
| 6,347,976 | B1 | 2/2002 | Lawton et al. | |
| 6,383,062 | B1 * | 5/2002 | Jou | 451/90 |
| 6,557,815 | B1 | 5/2003 | Klein, II | |
| 6,896,192 | B2 | 5/2005 | Horan et al. | |
| 2003/0178503 | A1 | 9/2003 | Horan et al. | |
| 2004/0053561 | A1 | 3/2004 | Pieper | |

* cited by examiner

LIGHT BEAM TARGETING AND POSITIONING SYSTEM FOR A PAINT OR COATING REMOVAL BLASTING SYSTEM

FIELD OF THE INVENTION

The invention relates to the removal of coatings, such as paint, from an underlying surface using blasting media. In particular, it relates to the use of an optical targeting and positioning system in such blasting applications.

BACKGROUND OF THE INVENTION

In order to remove coatings from underlying surfaces, industry is moving away from the use of chemical striping agents and towards the use of blasting techniques. With these blasting techniques, abrasive or non-abrasive media or water are blasted onto the coated surface at high velocity to remove the coating. There is a wide variety of blasting nozzles and blasting media on the market. The most widely used blasting systems use pressurized blasting media. Other systems use a suction feed in which the blasting media is fed into a high velocity air stream via suction. Suction feed systems do not typically have as much power as a pressurized blasting media system. Commonly used blasting media includes sand, plastic, glass or water, but there is also a wide range of specialized blasting media ranging from steel shots, on one hand, to corn starch or soybean media on the other.

In a typical set up, the user holds the blasting nozzle by hand and blasts the media towards the workpiece. The distance that the blasting nozzle is from the workpiece is commonly referred to in the trade as "stand-off" distance. The stand-off distance is important because it regulates the velocity of the blasting media as it impacts the coated surface. The user aims the high-velocity jet containing the entrained blasting media at the surface until the coating is removed at that spot. The user then moves the jet across the surface in a back and forth motion in order to remove the coating from the surface. When the user starts a job, the user might not know the thickness of the coating and therefore must guess through trial and error or experience as to the appropriate stand-off distance.

If the nozzle is too close, impact of the blasting media may damage the surface. On the other hand, if the stand-off distance is too great, the blasting media will not have enough velocity to remove the coating. The ideal stand-off distance for a majority of blasting media is about 12 inches. Corn starch or soybean media or water blasting requires a distance of about 6 inches. On the other hand using steel shots as a blasting media may require a stand off distance of about 18 inches. The appropriate stand-off distance for a given situation also depends on the pressure at the blasting nozzle as well as the thickness of the coating and the characteristics of the underlying substrate. For example, when the underlying substrate is made of a certain types of light weight composite material, holding the blasting nozzle too close to the substrate might not only damage the surface of the substrate, but might actually blow a hole through the substrate.

Thus, the optimum stand-off distance varies in the field depending on many factors including the type of blasting system being used (e.g. pressurized blasting media, water blasting, suction feed, etc.) and its set up parameters, the type of blasting media being used, the nature of the underlying substrate, the nature of the coating and possibly other factors. While there is some published data on what is believed to be the optimum stand-off distance under various conditions, such information is not often readily available to the user. Moreover, even armed with knowledge of the optimum stand-off distances under various conditions, it is difficult for users to maintain the blasting nozzle at the optimum stand-off distance from the surface as they move the nozzle back and forth the remove the coating. This can be especially difficult for novices.

The Assignee of this application has developed optical targeting and positioning systems for spray painting apparatus. Representative systems are shown in Klein II et al U.S. Pat. No. 5,598,972 issued Feb. 4, 1007; Klein II et al U.S. Pat. No. 5,857,625 issued Jan. 12, 1999 the disclosures of which are hereby incorporated by reference. Generally, these patents illustrate the concept of mounting a light beam emission arrangement on a spray paint gun or within the housing of the spray paint gun. The light beam emission apparatus directs a pair of light beams in a direction from the gun towards the surface to be sprayed. The light beams are oriented so as to converge towards each other as the beams propagate in a direction away from the gun towards the surface. The light beams form spots on the surface. The spots are aligned on the surface, such as merged together to form a single point of light on the surface, when the spray head of the spray gun is held at a predetermined stand-off distance from the surface. The angle of the light beams can be adjusted to vary the convergence distance, thus allowing the user to customize the desired stand-off distance indicated by the optical positioning system. The user can accommodate different spray painting operating parameters or characteristics, such as air pressure, coating type and the like, when setting up the optical positioning system for the appropriate stand-off distance, thus facilitating optimal application of the spray coating (e.g. paint) to the surface and minimizing overspray and waste. While this type of targeting and positioning system has been proven effective to optimize the application of sprayed coatings, it has not heretofore been used in connection with coating removal systems using blasting media.

Horan U.S. Patent Application US2003/0178503A1 entitled "Single Beam Spray Gun Positioning System", filed on Mar. 20, 2002 and published on Sep. 25, 2003 discloses a targeting and positioning system for a spray paint gun in which a single light beam is used to provide a rough estimate the distance of the spray nozzle from the surface being painted. The system does this by illuminating an optical beam at an angular orientation with respect to the center line of the spray pattern. It then requires the user to align the illuminated spot on the surface with the approximate center of the spray pattern on the surface being painted. As with the two beam systems described above, the desired stand-off distance can be adjusted by adjusting the direction of the light beam.

SUMMARY OF THE INVENTION

The invention involves use of optical beam targeting and positioning systems in a blasting system for removing coatings (e.g. paint) from an underlying surface or substrate. In one aspect, the invention is a method for positioning a blasting nozzle at a selected stand-off distance from the surface from which it is desired to remove a coating. The method includes the steps of emitting a first light beam from the blasting nozzle or an attachment to the blasting nozzle and propagating the beam in a first direction towards the coated surface to illuminate a first spot on the surface. This first light beam is preferable propagated in a fixed forward direction. This beam is referred to as the reference beam. A second light beam, referred to as the gauge beam, is also emitted from the blasting nozzle or an attachment to the blasting nozzle. The second beam or gauge beam propagates in a second direction towards the surface to illuminate a second spot on the surface. The gauge beam is not parallel to the reference beam. The orientation of the light beams is set to facilitate the locating of the blasting nozzle at the selected stand-off distance from the surface. This is accomplished when the first and second illuminated spots are aligned on the surface, preferably as an illuminated convergence point, when the nozzle is located at the desired stand-off distance from the surface. Preferably, the user can adjust the selected stand-off distance by adjusting the direction of the gauge beam with respect to the direction of the reference beam by a selected amount. Also preferably, the beams should be oriented so that the illuminated convergence point is located roughly in the center of the jet of blasting media as it impinges the surface.

The invention also contemplates the use of a single light beam method in which the first light beam or reference beam propagating in the forward direction towards the surface is eliminated. Rather, the blasting media expelled from the nozzle in the fixed forward direction acts as a rough proxy for the reference beam. When the hand-held blasting nozzle is located at the selected stand-off distance in this embodiment, the gauge light beam illuminates a spot on the surface in the center of the jet as it impinges the surface.

In another aspect, the invention relates to coating removal systems implementing the above described methods. In one embodiment, the system comprises the combination of a blasting nozzle to which a light beam targeting and positioning device is mounted. In another embodiment, the light beam targeting and positioning device is integral with the blasting nozzle, and preferably located within the housing of the nozzle. In either set up, the light beam targeting and positioning device preferably emits two light beams: a reference beam and a gauge beam. In a system in which the light beam targeting and positioning device is mounted to the blasting nozzle, it is preferred that a single laser produce a generated beam, and that a beam splitter be employed to split the generated beam into the first (reference) and second (gauge) light beams. In such a system, the targeting and positioning unit further comprises an adjustable reflecting mirror that reflects the second (gauge) beam towards the surface. A control knob is provided so that the user can change the attitude of the reflecting mirror and thereby adjust the orientation between the first (reference) and second (gauge) beams and thus change the selected stand-off distance at which the first and second illuminated points out align or converge with each other on the surface.

When the coating removal system includes a light beam targeting and positioning device that is integral with or interior to the housing of the blasting nozzle, it may be preferred to use two separate light generating devices with at least one having an adjustable orientation, although it is possible to use a singe light generating device with the beam splitter as described above. When the light beam targeting and positioning device is disposed within the interior of the housing, the light beams must be communicated exteriorly of the housing towards the surface preferably through a pair of light emission locations spaced apart from each other on the housing.

Of course, systems using a single gauge beam without a reference beam use a single laser without a beam splitter to generate the single beam.

Various other features, objects and advantages of the invention will be made apparent from the drawings and the following description.

DETAILED DESCRIPTION OF THE PREFERRED EMBODIMENTS

Figure 1:
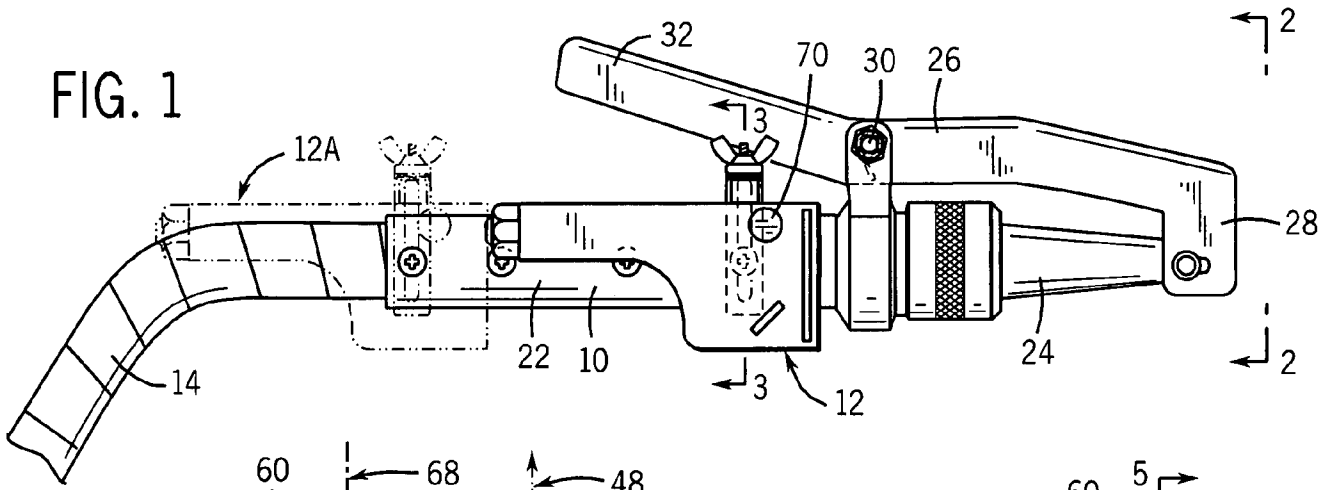
FIG. 1 is a side elevational view of a hand-held blasting nozzle having an optical light beam targeting and positioning device mounted thereto in accordance with a first embodiment of the invention.
Figure 4:
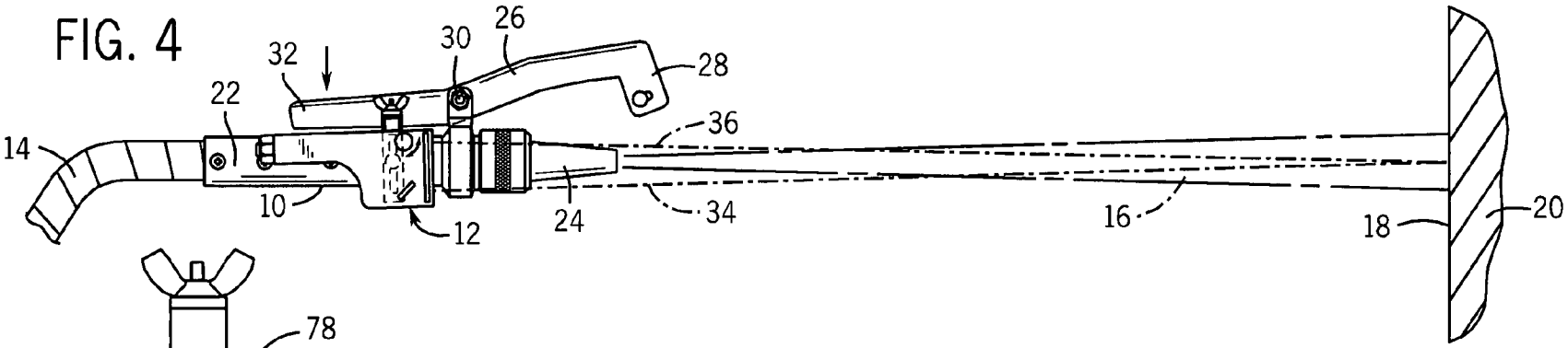
FIG. 4 is a schematic view illustrating the use of the light beam targeting and positioning unit to locate a hand-held blasting nozzle at a desired stand-off distance from a surface when blasting media is being expelled from the nozzle at the surface.

FIGS. 1 and 4 illustrate a hand-held blasting nozzle 10 having a light beam targeting and positioning system 12 mounted to the nozzle 10 in accordance with a first preferred embodiment of the invention. The blasting nozzle 10 is connected to a pressurized feed line 14 that supplies pressurized air and blasting media to the nozzle 10. In use, the blasting nozzle 10 is used to blast a high velocity jet 16 of blasting media onto a substrate 20 in order to remove a coating from the surface 18 of the substrate 20. The blasting nozzle 10 includes a barrel portion 22 and a tip 24 which is coaxially aligned with the nozzle. A levered valve member 26 is mounted to the barrel 22. The levered valve 26 includes a valve stop 28 that covers the exit orifice of the nozzle tip 24 when the valve is closed. The levered valve member 26 is mounted to the nozzle barrel 22 such that the levered valve member 26 can rotate around a fulcrum 30. When the handle 32 of the levered valve member 26 is pushed towards the barrel 22 of the nozzle 10, the valve stop 28 rotates upward and allows a high velocity jet 16 of blasting media to be expelled from the blasting nozzle 10, as shown in FIG. 4. While the blasting nozzle 10 illustrated in FIGS. 1 and 4 represent the construction of blasting nozzles commonly used throughout industry, it should be recognized that in accordance with the invention, the light beam targeting and positioning system 12 can be mounted to or integral with other types of blasting nozzles. Moreover, while the blasting nozzle 10 depicted in the drawings is hand-held, the invention is useful for automated or remote controlled systems as well. For example, in some systems in the art the user is located in a booth isolated from the blasting environment, and manipulates the blasting nozzle robotically using a remote control rather than holding the blasting nozzle in their hand.

Still referring to FIGS. 1 and 4, the light beam targeting and positioning system 12 emits two non-parallel laser beams: a reference beam 34 and a gauge beam 36. These beams 34 and 36 are shown schematically on FIG. 4 by broken lines. While it is preferred that the beams 34 and 36 converge to illuminate a single spot on the surface 18 when the nozzle 10 is located at the selected stand-off distance from the surface 18, the invention can be implemented without convergence to a single point. For example, the illuminated spots from the beams 34 and 36 on the surface 18 can come in to horizontal or vertical alignment as an indication of the nozzle 10 being located at the appropriate stand-off distance from the surface 18. Moreover, the invention can be implemented with a light beam targeting and positioning system that emits only a single light beam. In such a system, the center of the spray pattern is used as a rough estimate for the reference beam. The gauge beam 36 propagates at an angular orientation with respect to the center line of the jet 16 of blasting material media. The blasting nozzle 10 would be located at a distance from the surface 18 such that the illuminated spot on the surface is located roughly in the center of the jet of blasting media as it impinges the surface 18.

Referring again to the specific embodiment shown in FIGS. 1 and 4, the light beam targeting and positioning unit 12 is mounted to the blasting nozzle 10 such that the reference beam 34 propagates in the same forward direction as defined by the high velocity jet 16 of blasting media. In other words, the reference beam 34 propagates in the same generally forward direction that the gun is aimed. The reference beam 34 illuminates the substrate surface 18 at a first illumination location. The gauge beam 36 emits from the light beam unit 12 at a location that is offset from the location where the reference beam 34 emits from the unit 12. The gauge beam 36 propagates from the unit 12 and intersects the reference beam 34 at a convergence point which is illustrated in FIG. 4 to occur at the surface 18.

Figure 2:
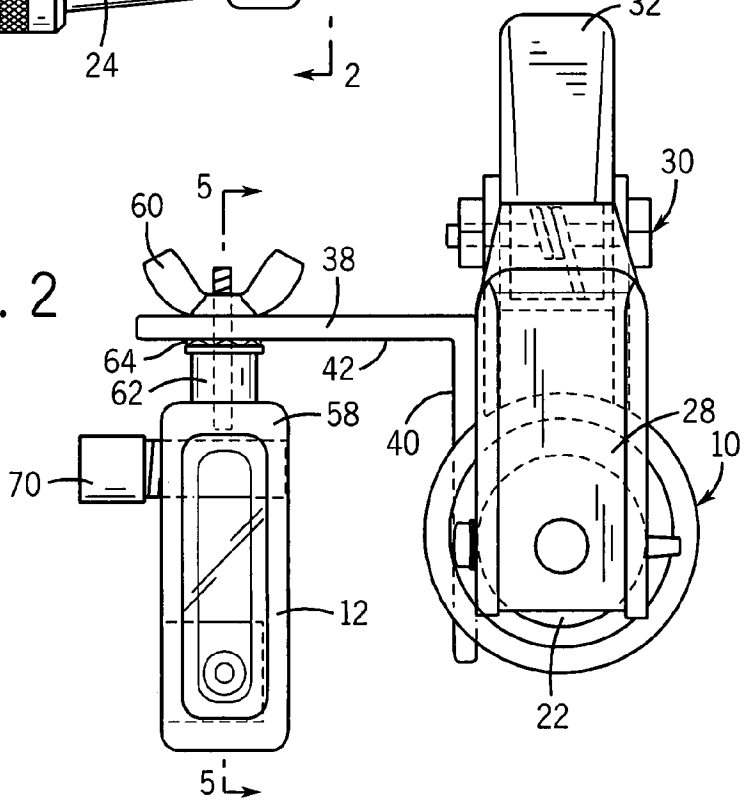
FIG. 2 is a front elevational view of the hand-held blasting nozzle and light beam targeting and positioning unit shown in FIG. 1.
Figure 3:
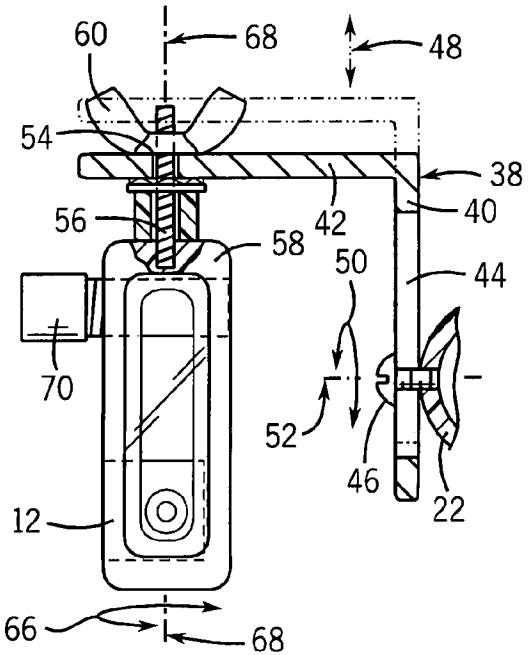
FIG. 3 is schematic view illustrating adjustments that can be made while mounting the light beam targeting and positioning unit to the hand-held blasting nozzle.

Referring now to FIGS. 2 and 3, the laser targeting and positioning unit 12 is preferably mounted to the nozzle barrel 22 using an adjustable mounting bracket 38. The adjustable mounting bracket 38 has a vertical leg 40 and a horizontal leg 42 which intersect to form a right angle. The vertical leg 40 includes a longitudinal slot 44. A screw 46 passing through the slot 44 is used to mount the bracket 38 to the barrel 22. Arrow 48 in FIG. 3 illustrates that the vertical position of the bracket 38 with respect to the nozzle barrel 22 can be adjusted by moving the screw position within the slot 44. Arrow 50 indicates that the angular orientation of the bracket 38 with respect to the horizontal axis 52 (axis of the screw 40) can be adjusted as well. The horizontal leg 42 of the bracket 38 contains a mounting hole 54 for a threaded stud 56 protruding from the top surface of the laser targeting and positioning unit 12. The base of threaded stud 56 is vertically fixed to the housing body 58 of the unit 12. A wing nut 60 is used to attach the threaded stud 56 to the horizontal leg 42 of the mounting bracket 38, bushing 62 and washer 64 facilitate this attachment and maintain separation between the horizontal leg 42 of the bracket 38 and the housing 58. Arrow 66 in FIG. 3 illustrates that the angular orientation with respect to the vertical axis 68 (axis of the stud 56) can be adjusted. Prior to use, the user should adjust the mounting bracket 38 vertically in accordance with arrow 48, and angularly with respect to arrows 50 and 66 so that the reference beam 34 impinges on the surface 18 of the substrate 20 at a location desired by the user when the blasting nozzle 10 is placed at the expected stand-off distance for the user's application. For example, the user might mount the laser targeting and positioning unit 12 so that the reference beam 34 impinges on the surface 18 roughly in the expected center of the jet 16 as it impinges the surface 18 when the tip 24 of the blasting nozzle 10 is located 12 inches from the surface 18.

Reference numeral 12*a* in FIG. 1 illustrates that it may be desirable to mount the light targeting and positioning unit 12 at different locations along the length of the nozzle barrel 22. The adjustable mounting bracket 38 described in FIGS. 2 and 3 is well adapted for such use.

Figure 5:
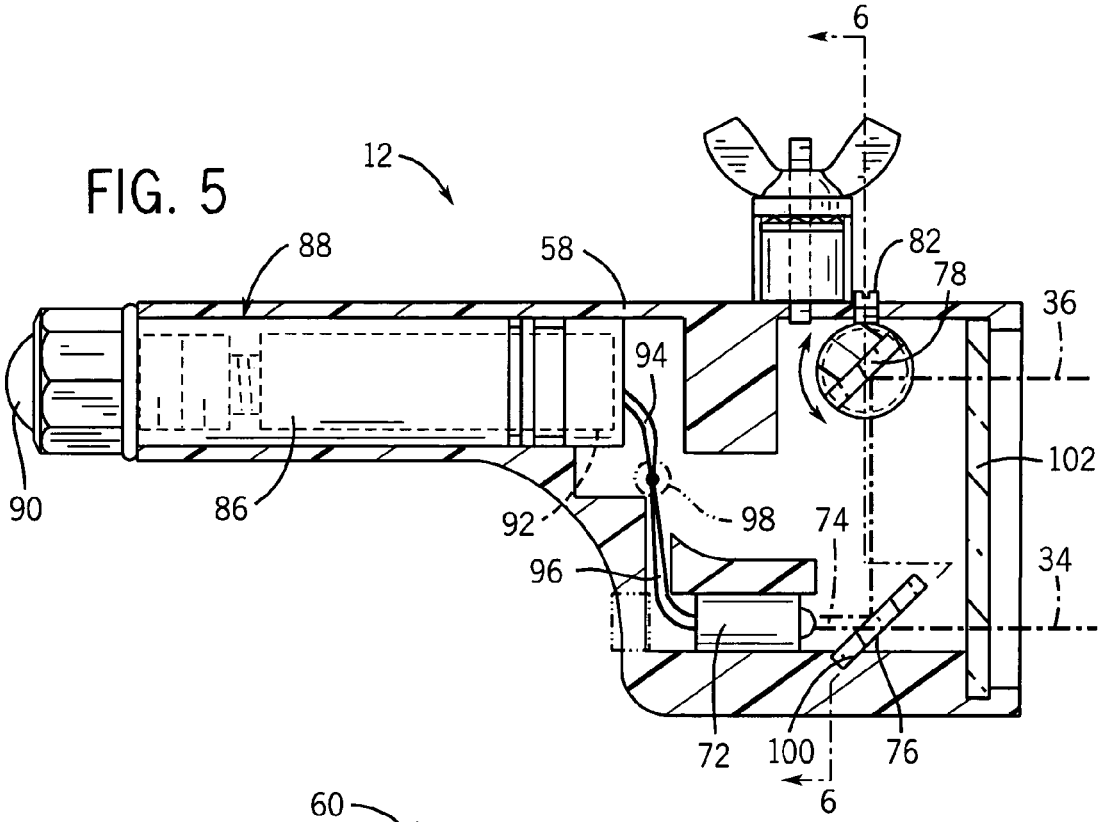
FIG. 5 is a sectional view of the optical targeting and positioning device taken along line 5-5 in FIG. 2.
Figure 6:
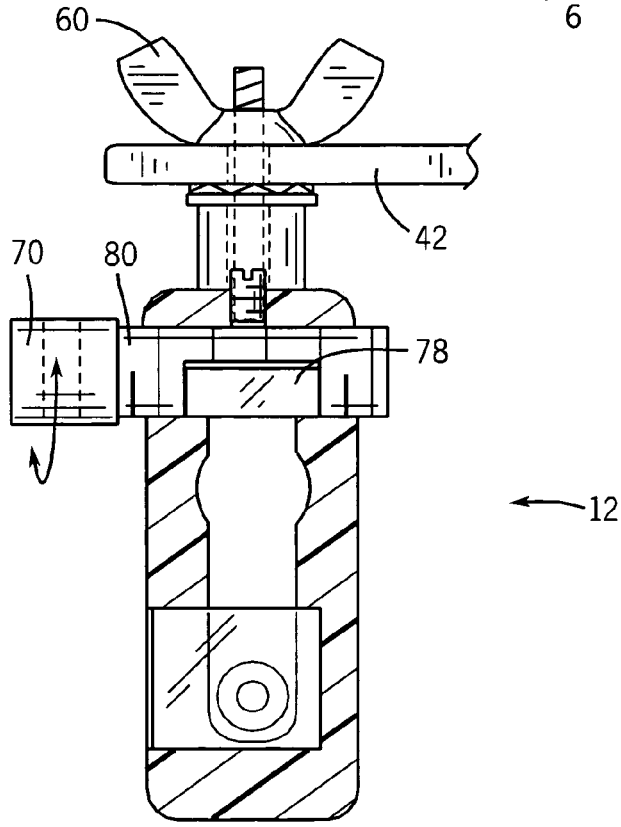
FIG. 6 is a sectional view of the light beam targeting and positioning device taken along line 6-6 in FIG. 5.

FIGS. 5 and 6 show the light beam targeting and positioning unit 12 of the first preferred embodiment in more detail. The unit 12 has a diode laser 72 that emits a laser beam 74. The laser beam 74 propagates towards a beam splitter 76 in a fixed forward direction. The laser diode is preferably a class IIIA type laser with a wave length 630 to 680 nM and a peak power of less than 5 mW. The beam splitter 76 is a 50/50 beam splitter. The reference beam 34 propagates from the beam splitter 76 in the same fixed forward direction as the beam 74 is emitted from the laser 72. The beam splitter 76 is positioned within the housing at a 45° angle to the beam 74 from the laser 72, and thus the split beam (which becomes the gauge beam 36) propagates from the beam splitter 76 at a 90° angle from the reference beam 34 towards an adjustable reflecting mirror 78. The adjustable reflecting mirror 78 reflects the gauge beam 36 so that the reflected gauge beam 36 propagates from the adjustable mirror 78 in a plane that includes both the direction in which the reference beam 34 propagates and the splitting direction in which the gauge beam propagates towards the reflecting mirror 78. As shown best in FIG. 6, the reflecting mirror 78 is fixed to a threaded body 80 to which a control knob 70 is affixed or integral. The control know 70 is accessible to the user and adjusts the direction that the gauge beam 36 propagates. In this manner, adjusting the control knob 70 adjusts the stand-off distance at which the illuminated spots from the beams 34, 36 will converge or become aligned. The control knob 70 is preferably calibrated so that the user can select the stand-off distance from unit 12 to the surface 18. The unit preferable includes a set screw 82 through the housing 58 that can be used to fix the position of the control knob 70 and, hence, the reflecting mirror 78 once the user has established the desired stand-off distance and light beam orientation.

Figure 7:
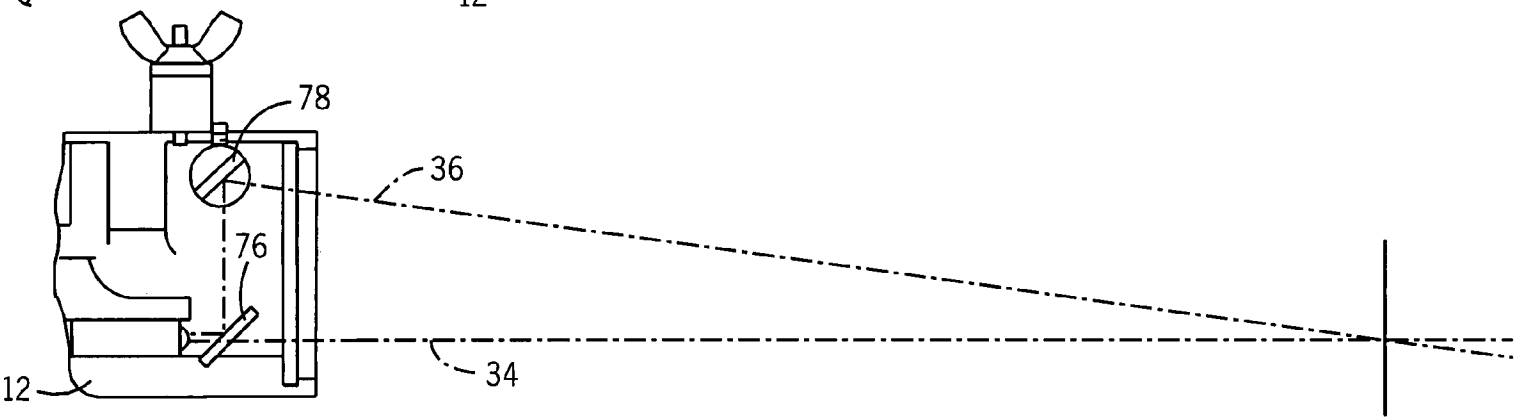
FIGS. 7 and 8 are schematic drawings illustrating the adjustment of the light beam targeting and positioning device to various desired stand-off distances.
Figure 8:
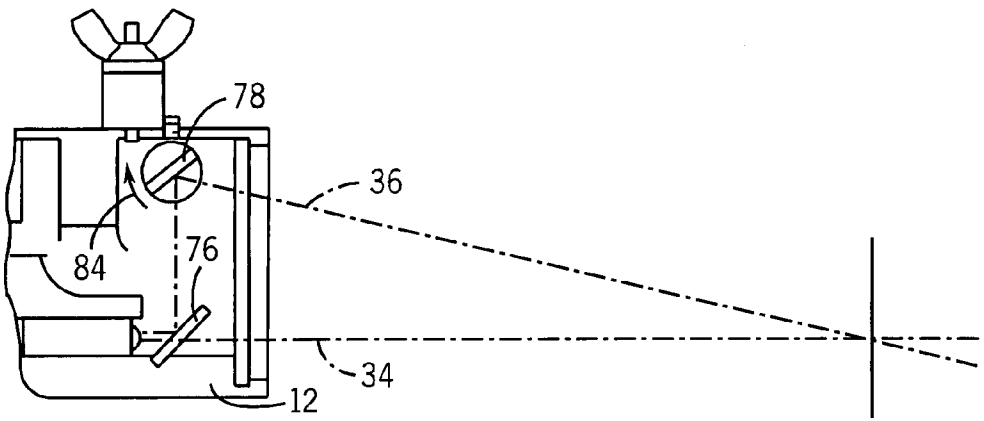

FIGS. 7 and 8 illustrate that the adjustment of the control knob 70 and the orientation of the reflecting mirror 78 changes the distance at which the beams 34, 36 converge or come into alignment. Note that the reflecting mirror 78 is roughly set at a 45° angle with respect to the beam being propagated from the beam splitter 76 in both cases. Arrow 84 in FIG. 8 shows that rotating the control knob 70 and reflecting mirror 78 slightly will shorten the convergence or alignment distance from unit 12 significantly.

Referring again to FIGS. 5 and 6, the housing 58 for the laser targeting and positioning unit 12 is preferably made of a single piece of machined acetal resin, such as sold under the trade name Delrin®. The housing body 58 is machined to provide access for assembling the components of the unit 12 within the housing 58, namely, laser diode 72, battery holder 88, beam splitter 76, control knob 70, reflecting mirror 78, and window 102 The laser diode 72 receives power from a battery 86, preferably a lithium battery (3.6 volts) which is housed within a battery holder 88. The battery holder 88 includes a switch 90 that is accessible to the user from the rear of the unit 12. D.C. power is provided from the terminal 92 of the battery holder 88 through wire 94 when the switch 90 is turned on. During assembly, the battery holder 88 is press fit into a machined opening in the rear of the housing 58. The laser diode 72 is inserted through a rearward looking access hole in a similar manner. The laser diode access hole is likewise plugged after assembly. An access hole 98 is preferably provided in the housing so that the wire 94 from the battery terminal 92 and a wire 96 leading to the laser diode 72 can be soldered together. After soldering, the access hole 98 is plugged. The housing 58 includes a machine slot 100 in which the beam splitter 76 is inserted in a fixed 45° position with respect to the laser diode emission. The window 102 is inserted in the housing 58 as well. If necessary, set screws can be used when necessary to maintain the fixed alignment of the laser diode 72. The housing 58 is threaded to receive the generally cylindrical body 80 to which the reflecting mirror 78 is attached (threads not shown in FIG. 6). The cylindrical body 80 is preferably machined plastic.

Figure 9:
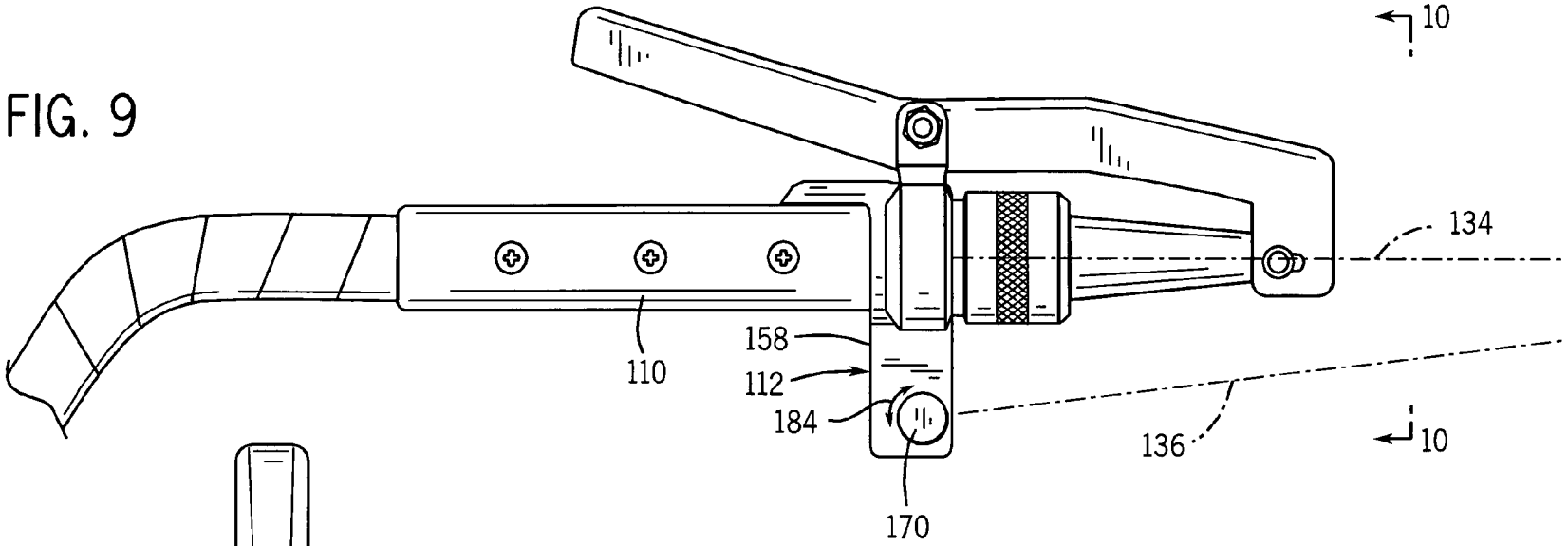
FIG. 9 is a side elevational view of a second embodiment of the invention in which a light beam targeting and positioning device is integral with the housing for the hand-held blasting nozzle.
Figure 10:
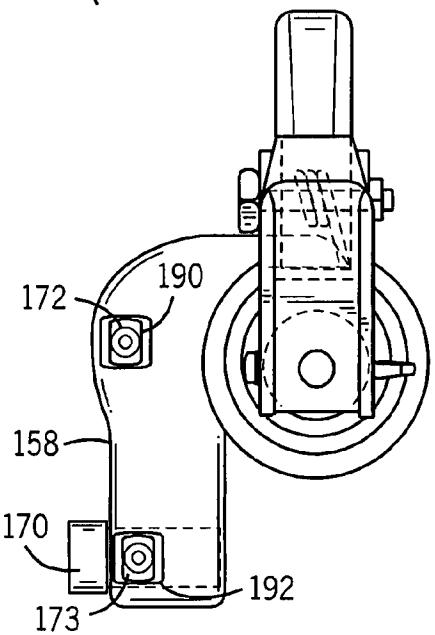
FIG. 10 is a front elevational view of the hand-held blasting nozzle shown in FIG. 9.

FIGS. 9 and 10 show another embodiment of the invention in which the laser targeting and positioning system 112 is integral with the hand-held blasting nozzle 110 and contained within a housing 158 for the hand-held blasting nozzle 110. In other respects, the blasting nozzle 110 shown in FIGS. 9 and 10 is similar to the blasting nozzle 10 illustrated in FIGS. 1-4. The embodiment shown in FIGS. 9 and 10 uses two separate light generating devices or laser diodes 172, 173 to produce the reference beam 134 and gauge beam 136 respectively. The laser diode 172 for the reference beam 134 is mounted within the housing at a fixed orientation, preferably in alignment with the longitudinal axis of the blasting nozzle 110 in the expected direction of the jet of expelled blasting media. On the other hand, the laser diode 173 that emits the gauge beam 136 is mounted such that its orientation can be changed by rotating control knob 170 as shown by arrow 184 in FIG. 9. Preferably, the control knob 170 is integral with or attached to a generally cylindrical threaded body (shown in phantom) to which the laser diode is affixed. A set screw (not shown in FIGS. 9 and 10) is preferably used to maintain the position of the control knob 170 and laser diode once the user has established the desired stand-off distance and light beam orientation. In this embodiment, it is preferred that the light beams 134, 136 be communicated from the interior of the housing 158 through a pair of light emission openings 190 and 192 in the housing 158 to the exterior of the housing. The light emission openings 190, 192 should be spaced apart from one another in appropriate distance. Although not shown in FIGS. 9 and 10, it is likely desirable that the diode lasers 172 and 173 be powered by battery power in a similar manner as described above with respect to FIG. 5.

It should be appreciated that modifications may be possible that do not substantially depart from the spirit of the invention and that such modifications should be considered as part of the invention. For example, in accordance with the invention, the integral unit described with respect to FIGS. 9 and 10 may use a single light generator or diode laser to create a single light beam, or with the combination of a beam splitter and reflecting mirror may create two light beams as described above with respect to FIGS. 1-8. Likewise, a system in which the laser targeting and positioning system 12 is mounted to an existing blasting nozzle 10, as in FIGS. 1-8, can use two light generating devices or diode lasers to generate the reference and gauge beams respectively, or as mentioned previously, can use a single light generating device or diode laser to generate a single beam while using the center of the jet pattern on the surface as a rough estimate for a reference beam.

What is claimed is:

1. In a blasting system for removing surface coatings, the system including a blasting nozzle from which blasting media is expelled as a high velocity jet, a method of positioning the nozzle at a selected stand-off distance from a surface from which it is desired to remove a coating in order to regulate the velocity of the expelled blasting media as it impacts the coated surface, the method comprising the steps of:

determining a selected stand-off distance for a blasting nozzle from a coated surface in accordance with one or more setup parameters including at least pressure;

expelling blasting media from the blasting nozzle as a high velocity jet of blasting media;

propagating a first light beam from the blasting nozzle or an attachment to the blasting nozzle in a first direction towards the surface to illuminate a first spot on the surface;

propagating a second light beam from the blasting nozzle or an attachment to the blasting nozzle in a second direction towards the surface to illuminate a second spot on the surface, the second light beam being non-parallel to the first light beam; and, locating the blasting nozzle at the selected stand-off distance from the surface in which the first and second illuminated spots are aligned, thereby regulating the velocity of the expelled blasting media as it impacts the coated surface.

2. The method as recited in claim 1 wherein the first and second illuminated spots form an illuminated convergence point when the nozzle is located at the selected stand-off distance from the surface.

3. The method as recited in claim 1 wherein:

the blasting media is expelled from the nozzle in a generally fixed forward direction;

the first light beam is a reference light beam that propagates in the fixed forward direction; and the second light beam is a gauge beam that propagates in an adjustable direction with respect to the fixed forward direction; and the method further comprises the step of:

adjusting the selected stand-off distance between the nozzle and the surface by adjusting the direction of the gauge beam with respect to direction of the reference beam by a desired amount.

4. The method as recited in claim 1 further comprising the step of:

aligning the first light beam so that the first illuminated spot on the surface is located roughly in the center of the jet of blasting media as the media impinges on the surface.

5. The method as recited in claim 1 wherein the blasting media is an abrasive blasting media.

6. The method as recited in claim 1 wherein the blasting media is a non-abrasive blasting media.

7. The method as recited in claim 1 wherein the blasting media is water.

8. The method as recited in claim 1 wherein the blasting nozzle is a hand-held blasting nozzle.

9. The method as recited in claim 1 wherein the blasting nozzle is manipulated by robotics remotely controlled by the user.

10. The method as recited in claim 1 wherein:

a light beam positioning device is mounted to or integral with the blasting nozzle, the device being adapted to emit a first light beam in a first direction away from the nozzle towards the surface and a second light beam in a second direction away from the nozzle towards the surface, the first and second directions being non-parallel, thereby illuminating a first spot and a second spot on the surface such that alignment of the spots provides an indication of the distance between the nozzle and the surface.

11. The system as recited in claim 10 wherein the light beam positioning device comprises:

a laser that generates an emitted beam; and a beam splitter that splits the emitted beam into the first and second light beams.

12. The system as recited in claim 11 wherein the light beam positioning device further comprises an adjustable reflecting mirror that reflects the second beam in order to adjust the orientation between the first and second beams such that adjusting the mirror adjusts the distance between the nozzle and the surface at which the first and second illuminated spots become aligned.

13. The system as recited in claim 12 wherein the light beam positioning device further comprises:

a control knob that can be adjusted to change the attitude of the reflecting mirror and thereby change the selected distance between the nozzle and the surface at which the first and second illuminated points on the surface align with each other.

14. The system as recited in claim 12 wherein the light beam positioning device further comprises:

a container that holds the laser, the beam splitter, and the adjustable reflecting mirror, and wherein the container is removably mounted to the remainder of the blasting nozzle in a fixed position relative to the nozzle and the direction in which the nozzle is generally aimed.

15. The system as recited in claim 10 wherein the first light beam is located in a horizontal plane through the center of the nozzle.

16. The coating removal system recited in claim 10 wherein:

the blasting nozzle comprises a housing defining an interior; and the light beam positioning device comprises a light generating device disposed within the interior of the housing and a light emitting arrangement for communicating the first and second light beams exteriorly of the housing towards the surface, and further wherein the light emitting arrangement defines a pair of light emission locations spaced apart from each other on the housing and operable to communicate the first and second light beams exteriorly of the housing toward the surface.

17. The system recited in claim 10 wherein the blasting nozzle is a hand-held blasting nozzle.

18. In a blasting system for removing surface coatings, the system including a blasting nozzle from which blasting media is expelled as a high velocity jet, a method of positioning the nozzle at a proper stand-off distance from the surface from which it is desired to remove a coating in order to regulate the velocity of the expelled blasting media as it impacts the coated surface, the method comprising the steps of:

determining a selected stand-off distance for a blasting nozzle from a coated surface in accordance with one or more setup parameters including at least pressure;

expelling blasting media from the blasting nozzle as a high velocity jet of blasting media;

expelling blasting media from the nozzle in a generally fixed forward direction towards the surface;

propagating a light beam from the blasting nozzle or an attachment to the blasting nozzle, towards the surface to illuminate a spot on a surface, the light beam being non-parallel to the forward direction in which the blasting media is expelled from the nozzle; and locating the blasting nozzle at the selected stand-off distance from the surface such that the illuminated spot on the surface is located roughly in the center of the jet of blasting media as the media impinges the surface, thereby regulating the velocity of the expelled blasting media as it impacts the coated surface.

* * * * *